US006622660B1

(12) United States Patent
Bajic et al.

(10) Patent No.: US 6,622,660 B1
(45) Date of Patent: Sep. 23, 2003

(54) BLOWER MIXING TEE

(75) Inventors: Boris Bajic, Cassville, MO (US); Bobby D. Garrison, Cassville, MO (US)

(73) Assignee: Fasco Industries, Inc., Cassville, MO (US)

( * ) Notice: Subject to any disclaimer, the term of this patent is extended or adjusted under 35 U.S.C. 154(b) by 0 days.

(21) Appl. No.: 10/280,874

(22) Filed: Oct. 25, 2002

(51) Int. Cl.[7] ..... F24H 1/00

(52) U.S. Cl. ..... 122/13.01; 122/17.1; 122/172; 122/18.31; 122/DIG. 7; 126/80

(58) Field of Search ..... 122/13.01, 17.1, 122/17.2, 48, 155.1, DIG. 7, 18.3, 18.31; 126/312, 80

(56) References Cited

U.S. PATENT DOCUMENTS 4,813,396 A * 3/1989 Sargeant et al. ..... 126/374.1
5,158,446 A * 10/1992 Hall ..... 431/20
5,255,665 A * 10/1993 Windon ..... 122/18.31
5,924,390 A * 7/1999 Bock ..... 122/17.2
6,112,741 A * 9/2000 Stickford et al. ..... 126/80
6,216,685 B1 * 4/2001 Payne ..... 126/80
6,231,311 B1 * 5/2001 Gatley et al. ..... 417/53
6,398,512 B2 * 6/2002 Stewart ..... 417/53

* cited by examiner

*Primary Examiner*—Jiping Lu
(74) *Attorney, Agent, or Firm*—Andrus, Sceales, Starke & Sawall, LLP

(57) ABSTRACT

An exhaust system for withdrawing a supply of exhaust gases from an exhaust flue of a heater and expelling the exhaust gases to atmosphere at a remote location that includes a mixing tee for mixing a flow of dilution air and a flow of exhaust gases. The mixing tee includes a first end coupled to the inlet opening of a blower housing and a second end coupled to a supply of dilution air. The dilution air inlet pipe of the mixing tee extends along a longitudinal axis. The mixing tee includes a flue pipe having a first end positioned to receive the exhaust gases from the heater and a second end that enters into the dilution air inlet pipe. The flue pipe extends along a longitudinal axis that is positioned at an angle relative to the longitudinal axis of the dilution air inlet pipe. The exhaust flue extends toward the upstream end of the dilution air inlet pipe such that the flow of dilution air impinges upon the flow of exhaust gases.

10 Claims, 5 Drawing Sheets

BLOWER MIXING TEE

BACKGROUND OF THE INVENTION

The present invention is directed to a blower assembly for use in expelling exhaust gases from a gas or oil fired burner, such as a water heater. More specifically, the present invention is directed to a unique exhaust configuration for expelling exhaust gases from a water heater and mixing the exhaust gases with dilution air.

Water heaters have been around for numerous years to provide hot water for both commercial and consumer usage. A water heater is commonly produced with a gas or oil fired burner. The burner produces a flame that heats the base of the water heater and the hot gases generated by the burner are channeled through the center of the water heater in a flue. The heat from the hot exhaust gases in the flue is transferred to the surrounding water to extract the maximum amount of heat to increase the fuel efficiency of the water heater.

To maximize the amount of heat transferred from the flue to the water, the flue is typically produced with baffles to provide the most tortured path allowable. The amount of baffles in a flow path is limited by the required flow throughput of the flue to prevent the harmful build up of carbon monoxide within the room because of incomplete combustion of the spent gases. The limited amount of baffles in a regular water heater caused several undesirable side effects, the most important of which was a maximum overall operating efficiency limited to approximately 58 percent.

The low efficiency of the water heater is caused by the gases exiting the water heater at a higher than desired temperature because of the required throughput of the exhaust flue. This created large stand-by losses when the heated water was not being used because the heat from the water transferred back out through the flue due to drafts, thereby causing increased fuel usage to maintain water temperature in the standby mode.

The problems identified above were addressed by adding a blower to the water heater. The use of a blower induces a draft through the exhaust flue which allows a more tortured path for the exhaust flue, thereby allowing a transfer of a greater amount of heat from the flue gases to the water. The blower would turn on only when the burner was on, thereby drawing the spent exhaust gases from the flue. Without the aid of a blower, the flow through the flue is dramatically reduced, which can cause a potential back up of spent exhaust gases at the burner.

With the use of a blower, the overall efficiency of a water heater can be increased to about 68 percent. This increase is mainly achieved through the reduced heat losses in the standby mode and the more efficient transfer of heat during the heating mode. The decrease in losses during the standby mode was achieved because there is little flow through the flue without the presence of extremely hot gases and the blower motor running. With reduced air flow through the flue in the standby mode, heat transfer losses were effectively reduced.

An additional benefit of the use of a blower on a water heater was that the temperatures of the exhaust gases exiting the flue were reduced because of more efficient heat scrubbing. In naturally aspirated water heaters, the exhaust gases contained in the flue that exited the water heater were relatively hot. This required the use of steel exhaust tubing that needed to be vented to the outside of the home or building in a nearly vertical manner for safety reasons. The use of a blower reduced the temperatures of the spent exhaust gases to the point that wider selections of materials were available for exhaust piping. Specifically, the use of a blower allowed for the safe use of PVC piping and the horizontal venting through the nearest wall to vent the exhaust gases to the outside atmosphere.

However, the use of a blower with a water heater presented several engineering challenges. The exhaust gases in the flue, while much lower in temperature than normally aspirated water heaters, were still above ideal temperatures for the direct venting through a PVC pipe. To reduce the exhaust gases to a desired temperature, the hot exhaust gases are mixed with dilution air at ambient temperature.

A prior art solution to adding dilution air to exhaust gases was the use of a T-connection attached to the flue with dilution air being drawn through one side of the T-connection and the blower assembly attached on the opposing side. When the blower motor is operated, the blower draws both exhaust gases from the water heater and dilution air into contact with each other to cool the exhaust gases before the exhaust gas/dilution air mixture is exhausted from the blower assembly through the PVC exhaust pipe.

A problem associated with the use of a T-connection for mixing dilution air with expelled exhaust gases from the water heater is the sizing and operation of the blower assembly for both maximum and minimum vent lengths. Any exhaust system design, and specifically the blower assembly, must be able to perform within agency-set standards at both a minimum vent length and a maximum vent length, as well as vent lengths in between.

The agency standard that impacts the minimum length flue pipe operation is the maximum allowable exhaust temperatures. Typically, the maximum allowable exhaust temperature is 157 degrees Fahrenheit wall temperature for the PVC piping attached to the blower. During minimum vent length applications, the blower assembly sees less resistance to drawing air into the blower housing and thus has a tendency to over-draw the burner system. The over-drawing of the burner results in an increased volume of flue gases moving too quickly past the water heaters baffle system, resulting in excessive exhaust temperatures entering into the blower.

During maximum length flue pipe operations, the agency standard that impacts the operation of a blower system is the maximum allowable carbon monoxide levels. During maximum length flue pipe operation, the blower motor has a tendency to under-draw the flue gases from the water heater. Since the blower motor is under-drawing the flue gases, the gases leaving the water heater have a higher concentration of carbon monoxide.

Therefore, it is an object of the present invention to provide a unique exhaust system for a gas or oil fired burner that reduces the amount of exhaust gases drawn through the flue pipe of the water heater during minimum vent length applications while maximizing the amount of flue gases drawn through the burner system during a maximum vent length application. Further, it is an object of the present invention to provide such an exhaust system that utilizes current operating components without increasing the cost and complexity of the exhaust system.

SUMMARY OF THE INVENTION

The present invention is an exhaust system for withdrawing a supply of exhaust gases from an exhaust flue of a gas or oil fired burner and mixing the withdrawn exhaust gases with dilution air prior to expelling the exhaust gases to atmosphere at a remote location. The present invention is particularly useful with a water heater having an oil or gas fired burner.

The exhaust system of the present invention includes a blower assembly having an outer housing including an inlet opening and an exhaust outlet. The blower assembly includes an impeller mounted to an electric motor for rotation within the open blower housing. As the impeller rotates within the open blower housing, the impeller creates a source of negative pressure. The exhaust outlet of the blower housing is coupled to an exhaust pipe for discharging gases to atmosphere from within the open blower housing.

The exhaust system further includes a dilution air inlet pipe having a first end configured to receive a supply of dilution air and a second end in communication with the inlet opening of the blower housing. The dilution air inlet pipe generally extends along a longitudinal axis from the first end to the second end. As the impeller of the blower assembly rotates, the source of negative air pressure in the blower housing draws a flow of dilution air into the blower housing along the longitudinal axis of the dilution air inlet pipe.

The exhaust system further includes a flue pipe having a first end configured to receive exhaust gases from the exhaust flue of the heater. The second end of the flue pipe extends into the dilution air inlet pipe such that exhaust gases received within the flue pipe flow into the dilution air inlet pipe.

The flue pipe extends along a longitudinal axis that intersect the longitudinal axis of the dilution air inlet pipe. In accordance with the invention, the longitudinal axis of the flue pipe extends at an angle relative to the longitudinal axis of the dilution air inlet pipe. Specifically, the longitudinal axis of the flue pipe is angled toward the upstream, first end of the dilution air inlet pipe such that the flow of exhaust gases traveling within the flue pipe enter the dilution air inlet pipe at an angle against the flow of dilution air. Thus, the flow of dilution air impinges upon the flow of exhaust gases within the flue pipe.

The dilution air inlet pipe further includes a restrictor plate having an inlet orifice of a selected diameter. The size of the inlet orifice controls the flow rate of dilution air into the dilution air inlet pipe.

The mixing tee of the present invention includes both the dilution air inlet pipe and the flue pipe and is preferably formed as a unitary structure. Preferably, the mixing tee is formed from a metallic material that can withstand the elevated temperatures of the exhaust gases being withdrawn from the heater. In the preferred embodiment of the invention, the flue pipe extends at an angle of approximately 60° relative to the longitudinal axis of the dilution air inlet pipe.

During minimum vent length applications, the mixing tee of the present invention, which includes the dilution air inlet pipe and the flue pipe, reduces the overdrawing effect of the blower on the exhaust gases from the water heater. This reduction in overdrawing is created by the impingement of the flow of dilution air on the flow of exhaust gases due to the angled configuration between the flue pipe and the dilution air inlet pipe. As the flow of dilution air passes over the exit end of the exhaust flue pipe, the flow of dilution air acts to restrict the flow of exhaust gases. Thus, during a minimum vent length application, the blower assembly does not overdraw the burner of the water heater. Because of the reduction in the flow of exhaust gases during a minimum vent length application, the inlet orifice of the dilution air inlet pipe can be reduced.

During a maximum vent length application, the mixing tee of the present invention allows the blower assembly to draw an adequate amount of exhaust gases from the burner due to the inlet orifice included at the first end of the dilution air inlet pipe. The inlet orifice reduces the flow of dilution air, which allows the blower assembly to draw more air from the flue pipe.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
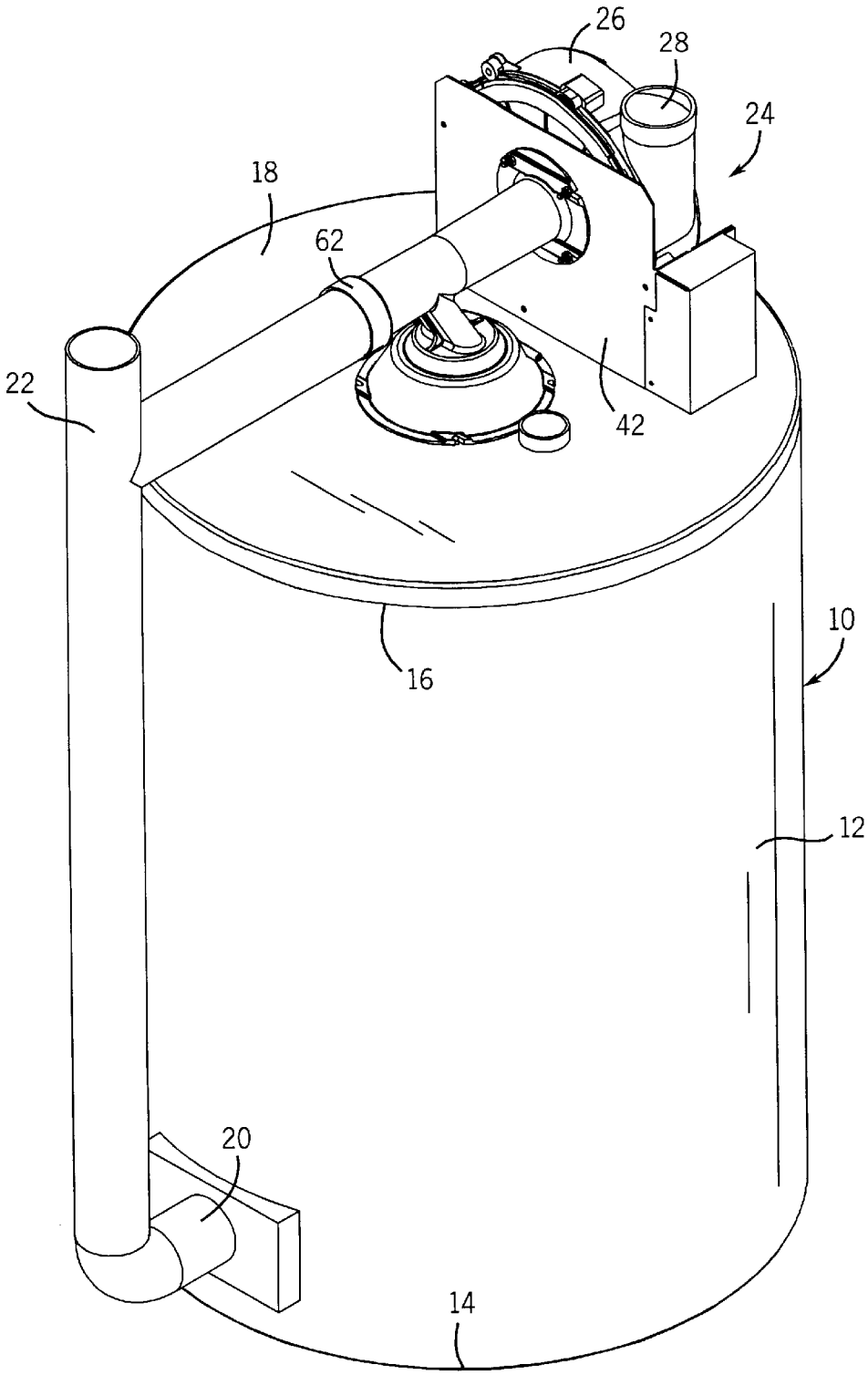
FIG. 1 is a perspective view illustrating a conventional water heater including a blower assembly for drawing exhaust gases from within the water heater.

Referring first to FIG. 1, thereshown is a conventional water heater 10 that utilizes the blower assembly and exhaust system of the present invention. The water heater 10 includes an outer shell 12 that extends between bottom end 14 and a top end 16. The top end 16 includes a generally flat, top surface 18. Although not illustrated, contained within the outer shell 12 of the water heater 10 is an internal burner that ignites a supply of fuel, such as oil or natural gas, to create a flame used to heat an internal supply of water. The internal burner of the present invention is fed by a source of fuel and a supply of fresh air through a combustion air inlet pipe 20. The combustion air inlet pipe 20 is connected to a supply of ambient air through an extended inlet pipe 22. In the preferred embodiment of the invention, the extended inlet pipe 22 extends outside of the home in which the water heater 10 is installed. Thus, the supply of fresh inlet air is received at an ambient temperature.

Although the preferred embodiment of the invention shown in FIG. 1 utilizes the combustion air inlet pipe 20 as a source of combustion air, it is contemplated by the inventors that the system of the present invention could be utilized with a water heater that utilizes air from near the base of the water heater to support combustion. This type of water heater is referred to as a power vent, while a water heater such as shown in FIG. 1 is referred to as a direct vent water heater.

Figure 5:
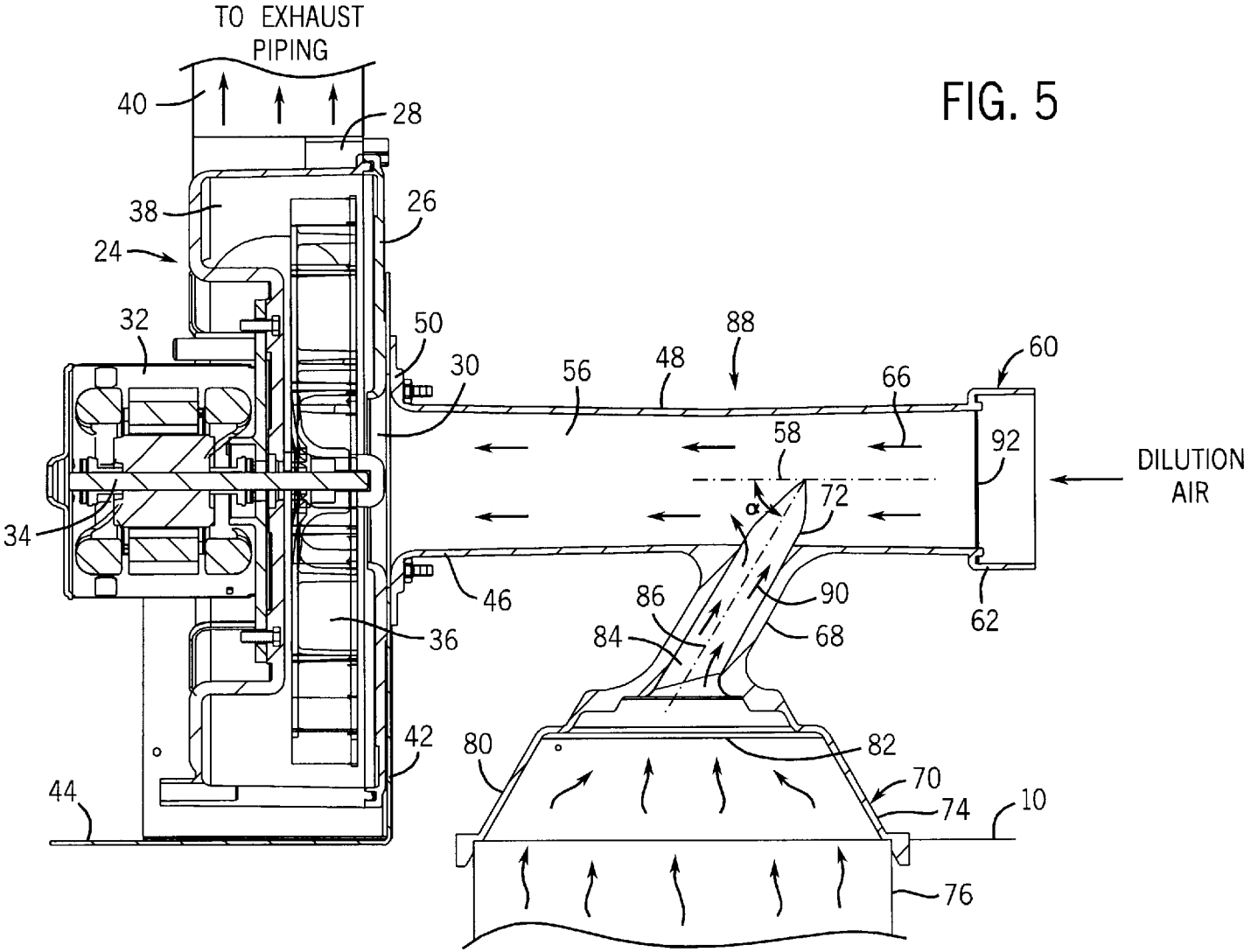
FIG. 5 is a section view taken along line 5—5 of FIG. 4 illustrating the internal configuration of the mixing tee.

As illustrated in FIG. 1, the water heater 10 includes a blower assembly 24 mounted to the top surface 18 of the water heater. As illustrated in FIGS. 1 and 5, the blower housing 26 is securely attached to a mounting plate 42 having a horizontal flange 44. The blower assembly 24 includes an outer housing 26 having an exhaust outlet 28 and an inlet opening 30, as best illustrated in FIG. 5. The outer housing 26 supports an electric motor 32 having a drive shaft 34 connected to an impeller 36. The impeller 36 is rotatable within an open impeller cavity 38 of the housing 26 to create a source of negative pressure to draw air into the blower housing 26 through the inlet opening 30.

The air drawn in through the inlet opening 30 is discharged through the exhaust outlet 28, which receives an exhaust pipe 40. The exhaust pipe 40 extends through the wall of the home including the water heater 10 to discharge the exhaust gases from the water heater burner.

In accordance with the present invention, the exhaust pipe 40 is a PVC pipe having an overall length dependent upon the distance from the water heater 10 to the nearest outlet from the home. As can be readily understood, the length of the exhaust pipe 40 effects the ability of the blower assembly 24 to adequately discharge exhaust gases from the water heater. For example, if the exhaust pipe 40 has an effective length of 40 feet, the amount of air being discharged from the blower assembly 24 is less than if the exhaust pipe 40 has an effective length of 4 feet. These maximum and minimum vent lengths effect the operation of the blower assembly 24, and more importantly, the amount of exhaust gases drawn from the water heater.

Figure 2:
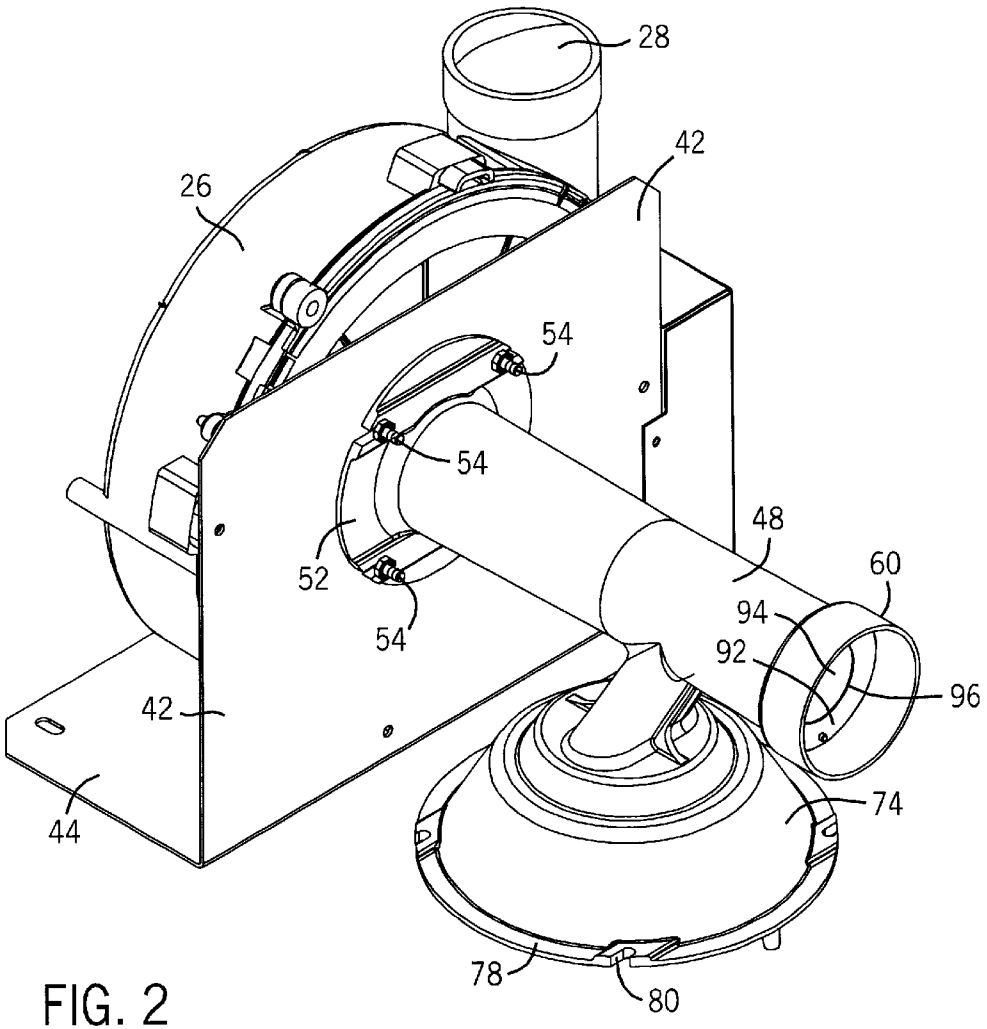
FIG. 2 is a magnified view of the blower assembly and a mixing tee utilized to draw both exhaust gases and dilution air into the blower assembly.
Figure 3:
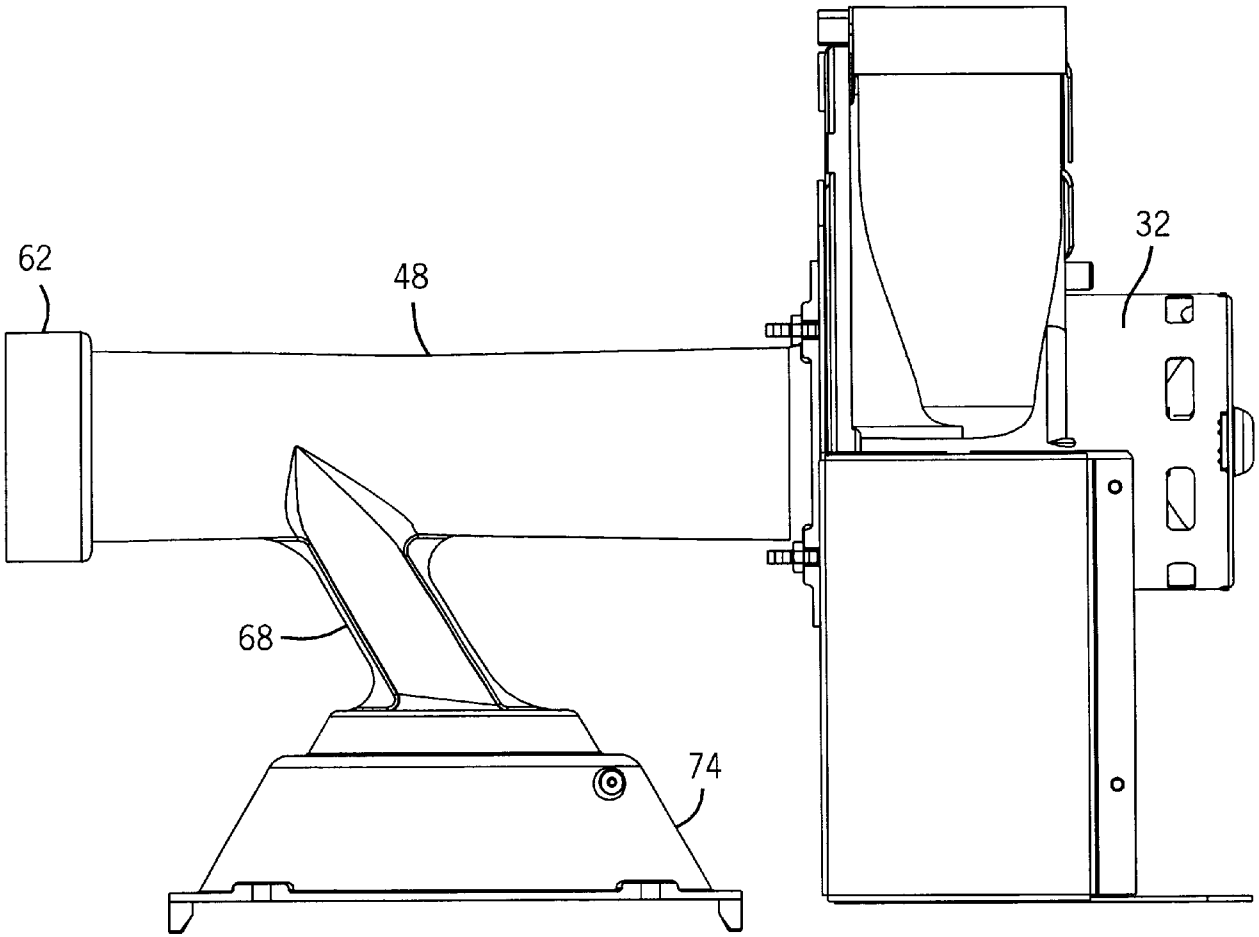
FIG. 3 is a side view of the blower assembly and mixing tee.
Figure 4:
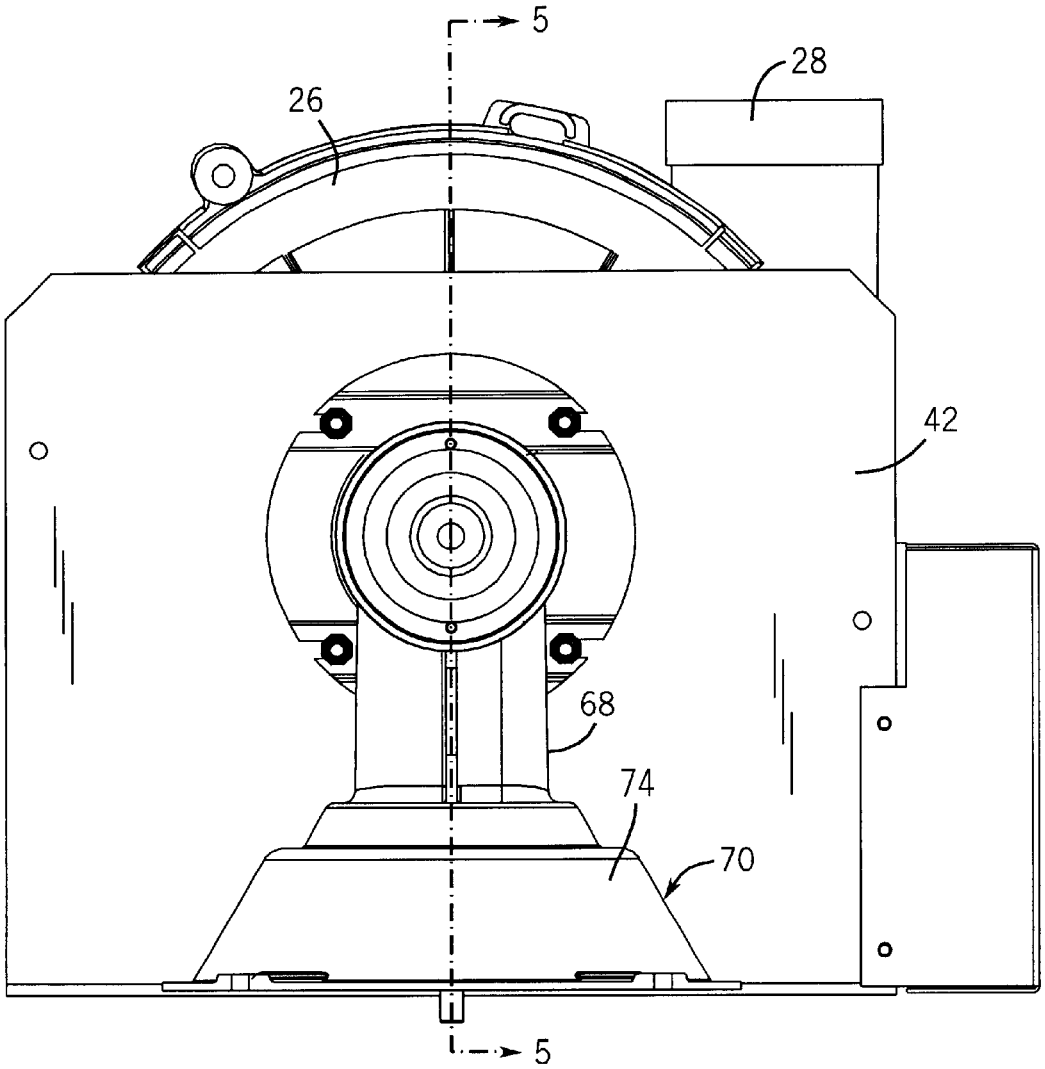
FIG. 4 is a front view of the blower assembly and mixing tee.

Referring now to FIGS. 2 and 5, the inlet opening 30 of the blower housing 26 receives a first end 46 of a dilution air inlet pipe 48. Specifically, the first end 46 includes an expanded diameter attachment flange 50 that is positioned over the inlet opening 30 and held in place by an attachment ring 52, as illustrated in FIG. 2. The attachment ring 52 is held in contact with the mounting plate 42 by a series of connectors 54.

As can be illustrated in FIG. 5, the open interior 56 of the dilution air inlet pipe 48 is thus in fluid communication with the inlet opening 30. The dilution air inlet pipe 48 extends along a longitudinal axis 58 from the first end 46 to a second end 60. As illustrated in FIG. 5, the second end 60 includes an expanded diameter receiving collar 62 that can receive another section of inlet pipe 64, as illustrated in FIG. 1. The inlet pipe 64 is ultimately connected to a supply of ambient air, which functions as dilution air as will be described in greater detail below.

Referring back to FIG. 5, the rotation of the impeller 36 within the blower housing 26 creates a flow of dilution air along the longitudinal axis 58, as best illustrated by the arrows 66 in FIG. 5. The flow of dilution air 66 passes through the open interior 56 and enters into the blower housing 26 through the inlet opening 30. The flow of dilution air 66 is created by the source of negative pressure within the impeller cavity 38 created by the rotating impeller 36, as is well known.

Referring back to FIG. 5, the dilution air inlet pipe 48 is connected to a flue pipe 68. The flue pipe 68 extends from a first end 70 to a second end 72. The first end 70 includes an expanded diameter bell section 74 sized to receive the exhaust flue 76 of the water heater. As illustrated in FIG. 2, the bell section 74 includes an outer flange 78 having a series of slots 80 each of which receive a connector to secure the bell section 74 over the exhaust flue of the water heater.

Referring back to FIG. 5, the bell section 74 includes a sloping outer wall 80 such that the bell section 74 decreases in diameter to an internal opening 82. The internal opening 82 provides access to the main, open interior 84 of the flue pipe 68. The open interior 84, and the entire flue pipe 68, extend along a flue pipe longitudinal axis 86 and the second end 72 of the flue pipe 68 opens into the open interior 56 of the dilution air inlet pipe 48.

In the embodiment of the invention illustrated in FIG. 5, both the dilution air inlet pipe 48 and the flue pipe 68 are formed as a one piece structure to define a mixing tee 88. The one-piece mixing tee 88 provides points of fluid communication with a supply of dilution air, the exhaust flue 76 of the water heater and the inlet opening 30 of the blower housing 26. Thus, when the electric motor 32 rotates the impeller 36, the negative pressure created within the impeller cavity 38 creates both a flow of dilution air, as illustrated by arrow 66 and a flow of exhaust gases, as illustrated by arrows 90. As illustrated in FIG. 5, the dilution air flow and the exhaust gas flow come into contact with each other at the junction between the second end 72 of the flue pipe 68 and the open interior 56 of the dilution air inlet pipe 48.

As illustrated in FIG. 5, the longitudinal axis 86 of the flue pipe 68 intersects the longitudinal axis 58 of the dilution air inlet pipe 48 at an angle extends toward the upstream, second end 60 of $\alpha$. In the embodiment of the invention illustrated, the angle $\alpha$ is preferably around 60° , although other angles are contemplated as being within the scope of the invention. Preferably, the angle $\alpha$ is between 50° and 70° for reasons that will be set forth below.

As can be understood in FIG. 5, the flow of exhaust gases, as illustrated by arrows 90, enters into the open interior 56 of the dilution air inlet pipe 48 against the direction of the dilution air inlet flow 66. As illustrated, the flue pipe 68 is angled toward the upstream end 60 of the dilution air inlet pipe 48 such that the flow of exhaust gases enter into the dilution air inlet pipe 48 against the flow of dilution air. Thus, the flow of dilution air impinges on the flow of exhaust gases, which results in additional resistance seen by the flow of exhaust gases, which in general, reduces the rate at which the exhaust gases are withdrawn from the exhaust flue 76 of the water heater 10.

Referring now to FIGS. 2 and 5, the second end 60 of the dilution air inlet pipe 48 includes a restrictor plate 92 that is mounted to the inner wall of the dilution air inlet pipe 48. The restrictor plate 92 includes an inlet orifice 94 defined by the inner edge 96 of the restrictor plate 92. The inlet orifice 94 is sized to control the flow of dilution air into the dilution air inlet pipe 48. The size of the inlet orifice 94 is used to control the mixing of the dilution air and exhaust gases that are drawn into the inlet opening 30.

The operation of the blower assembly 24 and the exhaust system will now be described for both a minimum and a maximum vent length configuration. Initially, the minimum vent length condition will be described. The minimum vent length refers to a configuration in which the exhaust piping and the dilution air inlet piping have a minimum length, such as is the case where the water heater 10 is positioned near the inlet and the outlet from the household in which the water heater 10 is installed. In a minimum vent length application, the blower assembly 24 sees a lower air resistance at both the exhaust pipe 40 and the dilution air inlet pipe 48. Thus, the rotation of the impeller 36 is able to more easily draw dilution air and exhaust gases into the impeller cavity 38 and expel the exhaust gases and dilution air through the exhaust pipe 40.

During a minimum vent application with a prior art system having a vertical flue pipe 68, the blower assembly 24 has a tendency to overdraw the burner system of the hot water heater 10. Specifically, in this type of prior art system, the blower 24 increases the volume of exhaust gases drawn through the flue pipe, which causes the exhaust gases to spend too little time within the baffle system of the hot water heater. Because the exhaust gases are being drawn more quickly from the water heater, the baffle system of the water heater is unable to extract the required amount of heat from the exhaust gases. Thus, the exhaust gases being drawn into the blower assembly 24 have an elevated temperature that falls outside of agency requirements. Additionally, the overdrawing of the water heater burner system results in a decrease in the efficiency of the water heater.

In the embodiment of the invention illustrated in FIG. 5, when the blower assembly 24 is used with a minimum vent length, the flow of dilution air 66 within the dilution air inlet pipe 48 is again elevated. At the same time, the blower begins to draw an increased flow of exhaust gases through the angled flue pipe 68. However, as the exhaust gases flow along the longitudinal axis 86, the exhaust gases enter into the open interior 56 of the inlet pipe 48 against the flow of dilution air along the longitudinal axis 58. The flow of dilution air thus impinges upon the flow of exhaust gases, which reduces the flow of exhaust gases entering into the open interior 56. Thus, the angle of the flue pipe 68 relative to the longitudinal axis 58 of the dilution air inlet pipe has the desired effect of reducing the amount of exhaust gases drawn during the minimum vent length application. The end result is that the burner is not overdrawn and the efficiency of the system is maintained.

In addition to ensuring the proper draw of exhaust gases during a minimum vent length application, the angle of the flue pipe 68 relative to the air inlet pipe 48 allows the size of the inlet orifice 94 to be decreased compared to what would otherwise be required for agency specified legal exhaust temperatures. This is directly due to the fact that a lower flow rate of exhaust gases are drawn from the water heater burner during a minimum vent length application. Because a smaller amount of exhaust gases are withdrawn, a smaller amount of dilution air can be drawn as well while maintaining the proper temperature of the dilution air/exhaust gas mixture.

During a maximum vent length application, which again refers to the combination of the exhaust piping effective length and the effective length of the dilution air inlet pipe, the angle of the flue pipe 68 again provides additional benefits. As described above in the discussion of the minimum vent length application, the diameter of the inlet orifice 94 shown in FIG. 2 can be reduced compared to a prior art system having a vertical flue pipe due to the impingement of the dilution air flow on the exhaust gas flow. Because the size of the inlet orifice has been reduced relative to prior art applications, a larger portion of the blower is available to pull flue gases through the burner system in a maximum vent length application, as compared to a prior art system.

In a maximum vent length application, a larger portion of the blower capacity is available to pull exhaust gases through the burner system. Since both the dilution air and the exhaust gases are attached to pipes, less dilution air is available to cool the maximum vent application, which is precisely the situation desired. Since less dilution air is being drawn through the reduced diameter inlet orifice 94, the flow of dilution air 66 past the second end 72 of the flue pipe 68 does not impinge as heavily upon the flow of exhaust gases. Thus, the angle of the flue pipe 68 does not significantly effect the ability of the blower assembly 24 to draw exhaust gases from the exhaust flue.

Various alternatives and embodiments are contemplated as being within the scope of the following claims particularly pointing out and distinctly claiming the subject matter regarded as the invention.

We claim:

1. An exhaust system for withdrawing a supply of exhaust gases from an exhaust flue of a heater and expelling the exhaust gases to atmosphere at a remote location, the system comprising:

a blower assembly having a housing and a rotating impeller for creating a source of negative pressure within the housing, the housing having an inlet opening and an exhaust outlet;

a dilution air inlet pipe having a first end configured to receive a supply of dilution air and a second end in communication with the inlet opening of the blower housing, the dilution air inlet pipe extending along a longitudinal axis, wherein the rotation of the impeller within the blower assembly creates a flow of dilution air in a first direction along the longitudinal axis of the dilution pipe from the first end to the second end; and a flue pipe having a first end configured to receive the exhaust gases from the exhaust flue of the heater and a second end in communication with the dilution air inlet pipe, the flue pipe extending along a longitudinal axis, wherein the rotation of the impeller in the blower housing creates a flow of exhaust gases that travels along the longitudinal axis of the flue pipe from the first end to the second end, wherein the longitudinal axis of the flue pipe is oriented at an angle relative to the longitudinal axis of the dilution air inlet pipe such that the flow of exhaust gases enters the inlet pipe against the flow of the dilution air.

2. The exhaust system of claim 1 wherein the dilution air inlet pipe and the flue pipe are integrally formed.

3. The exhaust system of claim 2 wherein the first end of the dilution air inlet pipe includes a restrictor plate having an inlet orifice sized to restrict the flow of dilution air through the dilution air inlet pipe.

4. The exhaust system of claim 1 wherein the angle between the flue pipe and the dilution air inlet pipe is between 50° and 70°.

5. The exhaust system of claim 1 wherein the second end of the flue pipe is joined to the dilution air inlet pipe between the first end of the inlet pipe and the second end of the inlet pipe.

6. A mixing tee for connecting an inlet opening of a blower assembly to an exhaust flue of a heater and a supply of dilution air, the mixing tee comprising:

a dilution air inlet pipe having a first end configured to receive a supply of dilution air and a second end configured to be received in the inlet opening of the blower housing, the dilution air inlet pipe extending along a longitudinal axis, wherein the rotation of the impeller within the blower assembly creates a flow of dilution air in a first direction along the longitudinal axis of the dilution pipe from the first end to the second end; and a flue pipe having a first end configured to receive the exhaust gases from the exhaust flue of the heater and a second end in communication with the dilution air inlet pipe, the flue pipe extending along a longitudinal axis, wherein the rotation of the impeller in the blower housing creates a flow of exhaust gases that travels along the longitudinal axis of the flue pipe from the first end to the second end, wherein the longitudinal axis of the flue pipe is oriented at an angle relative to the longitudinal axis of the dilution air inlet pipe such that the flow of exhaust gases enters the inlet pipe at against the flow of the dilution air.

7. The mixing tee of claim 6 wherein the first end of the dilution air inlet pipe includes a restrictor plate having an inlet orifice sized to restrict the flow of dilution air through the dilution air inlet pipe.

8. The mixing tee of claim 6 wherein the angle between the flue pipe and the dilution air inlet pipe is between 50° and 70°.

9. The mixing tee of claim 6 wherein the dilution air inlet pipe and the flue pipe are integrally formed from a metallic material.

10. The mixing tee of claim 6 wherein the longitudinal axis of the flue pipe extends toward the first end of the dilution air inlet pipe.

* * * * *